United States Patent [19]

Hickin et al.

[11] Patent Number: 4,591,844

[45] Date of Patent: May 27, 1986

[54] LINE SMOOTHING FOR A RASTER DISPLAY

[75] Inventors: Charles W. R. Hickin, Binghamton; Michael D. Austen, Johnson City, both of N.Y.

[73] Assignee: General Electric Company

[21] Appl. No.: 453,464

[22] Filed: Dec. 27, 1982

[51] Int. Cl.[4] ..... G09G 1/06

[52] U.S. Cl. ..... 340/728

[58] Field of Search ..... 340/728, 748, 750, 724, 340/731

[56] References Cited

U.S. PATENT DOCUMENTS

| | | | |
|---|---|---|---|
| 4,119,956 | 10/1978 | Murray | 340/324 |
| 4,212,009 | 7/1980 | Adleman et al. | 340/728 |
| 4,237,457 | 12/1980 | Houldsworth | 340/728 |
| 4,262,290 | 4/1981 | Vallins | 340/728 |
| 4,318,097 | 3/1982 | Oura | 340/728 |
| 4,371,872 | 2/1983 | Rossman | 340/728 |
| 4,415,889 | 11/1983 | Davis | 340/728 |
| 4,471,349 | 9/1984 | Strolle | 340/728 X |

*Primary Examiner*—Gerald L. Brigance
*Assistant Examiner*—Vincent P. Kovalick
*Attorney, Agent, or Firm*—I. David Blumenfeld

[57] ABSTRACT

This invention relates to a method of and apparatus for displaying a symbol on a display surface consisting of a matrix of discrete points (e.g. raster), where the symbol is divided into sections and the brightness of each pixel is controlled. This technique smooths out "stair-step" effects inherent in displays consisting of discrete points.

12 Claims, 27 Drawing Figures cb = CENTER OF BRIGHTNESS
cp = CENTER OF PIXEL
v = VERTICAL WIDTH
d = DISCONTINUITY a)

b)

LINE SMOOTHING FOR A RASTER DISPLAY

BACKGROUND OF THE INVENTION

1. Field of the Invention

This invention relates to display apparatus, and more particularly to a raster scan display provided with line smoothing means for smoothing out stair-step effects inherent in the raster display of line segments.

2. Description of the Prior Art

The display apparatus concerned here is the kind having a display area which is effectively a regular array of display elements on which a symbol is produced by brightening selected ones of the display elements. One example of such a display apparatus includes a cathode ray tube arranged to be line-scanned in a television-type raster with digital control of display element brightness. However, other forms of display apparatus are known; for example, an array of light-emitting diodes arranged to be scanned electronically.

One disadvantage of such display is that, due to the discrete nature of the display elements, some symbol lines, e.g., those at a large or small angle to the raster lines in a line scan raster-type display, tend to suffer from the so-called "stairstep" effect, that is, instead of the line having a clean staight edge, it has a stepped appearance resembling the treads and risers of a staircase.

It is, therefore, a principle object of the present invention to overcome the disadvantages attendant in the prior art approaches and to provide improved apparatus for smoothing out stair-step effects inherent in the raster display of line segments.

SUMMARY OF THE INVENTION

The above and other objects of the present invention are accomplished by providing apparatus, a display system, for displaying information including line segments to a viewer. Included is a raster scan display including a display surface having a plurality of pixels for presenting information to a viewer, the display having an input for receiving display signals and further including a display generator having an input for receiving information to be displayed and including means for smoothing-out stair-step effects inherent in the raster display of line segments, the generator having an output providing raster scan display signals to the display.

In another aspect of the invention there is provided a method for overcoming the stair-step effects inherent in displaying a line segment on a raster display and includes the steps of: constructing a line segment of finite width; dividing the line segment into equal parallelogram-shaped sections one pixel in width; dividing each section into pixels; and determining the percentage of the area of each pixel common to each line section.

BRIEF DESCRIPTION OF THE DRAWING

These and other features of the present invention will be readily apparent from the following description when taken with the accompanying drawing in which.

DESCRIPTION OF THE PREFERRED EMBODIMENT

Figure 1:
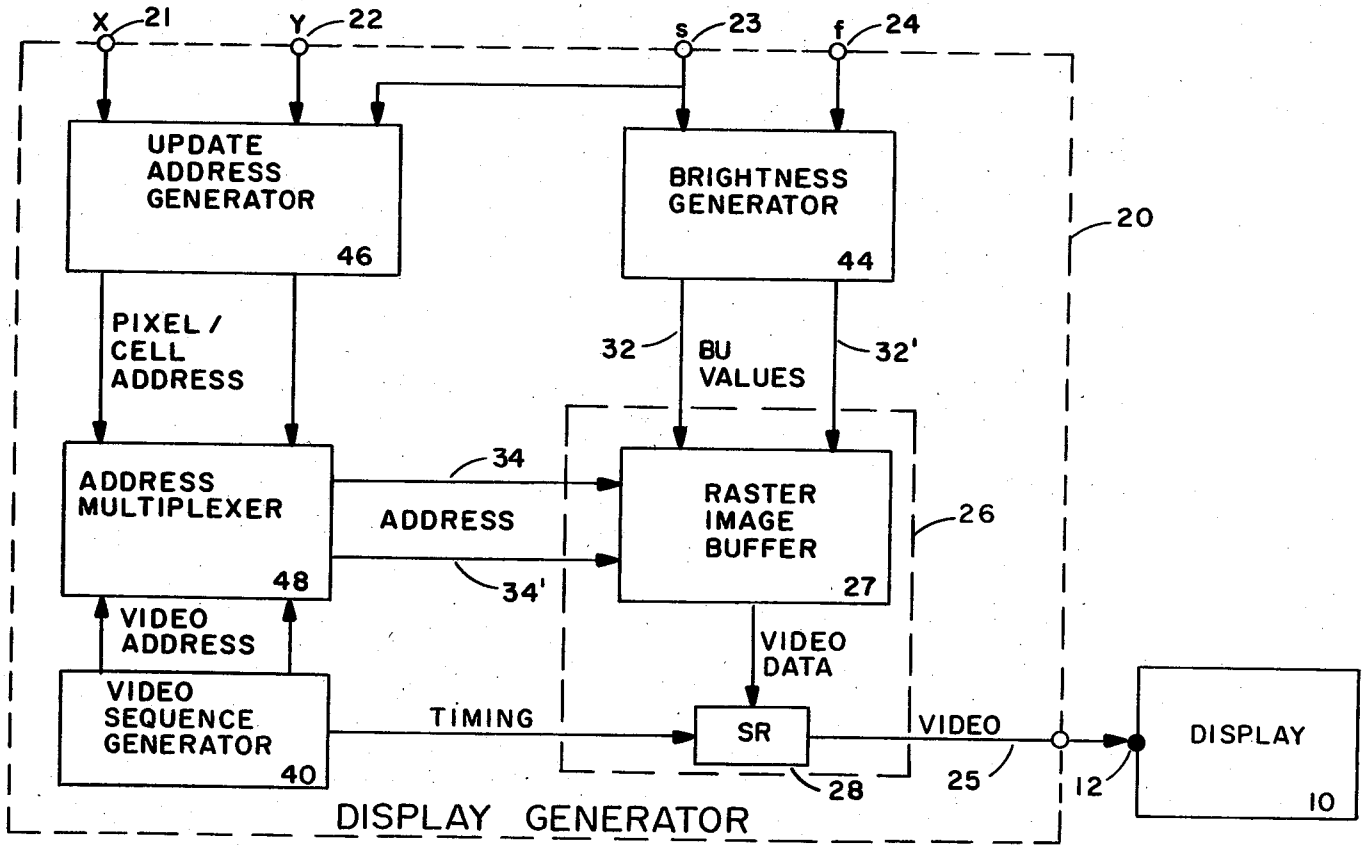
FIG. 1 shows in block diagram form the preferred embodiment of the display system of the present invention.

Referring now to FIG. 1, there is shown the preferred embodiment of the display system, of the present invention, for displaying information including line segments to a viewer. Included is a raster scanned display 10 of the type including a display surface having a plurality of pixels for presenting information to a viewer, the display having an input 12 for receiving display signals. Also included is a display generator 20 having an input in the form of input points 21, 22, 23, and 24 for receiving information to be displayed from the output of a conventional raster symbol generator and including means for smoothing out stair-step effects inherent in the raster display of line segments and which will hereinafter be described in more detail, the display generator having an output 25 providing raster scanned display signals to the display 10.

Inputs 21 and 22 receive respectively "X" and "Y" pixel positions and inputs 23 and 24 receive respectively the slope "s" of the line segment and the fractional position "f" of the center of brightness within the pixel, along the axis at the center of the section, parallel to the section, as will be described more fully hereinafter.

Display generator 20 further includes means 26 for storing brightness values of individual pixels, the storing means 26 including raster image buffer 27 and shift register 28. Storing means 26 is provided with inputs 32 and 32' for receiving brightness values for each pixel and inputs 34 and 34' for receiving a composite of "X"

and "Y" addresses and an output 25 providing raster scanned display signals to the input 12 of display 10.

Display generator 20 further includes first means for addressing the storing means 26 in a predetermined sequence for generation of display signals and such may take the form of video sequence generator 40.

Display generator 20 further includes means for generating pixel brightness values from the slope of the line segments and the fractional position of the center of brightness for each section of a line segment and takes the form of brightness generator 44. Second means are provided for addressing storing means 26 in a sequence determined by the inputs to the display generator 20 and takes the form of update address generator 46, also forming a part of display generator 20.

Means are provided for routing the outputs of the update address generator 46 and video sequence generator 40 to the storing means 26 and takes the form of address multiplexer 48.

Shift register 28 receives timing information from video sequence generator 40 and also serves to convert video data information received from the raster image buffer 27 into display signals appropriate for reception by the display 10.

Figure 2:
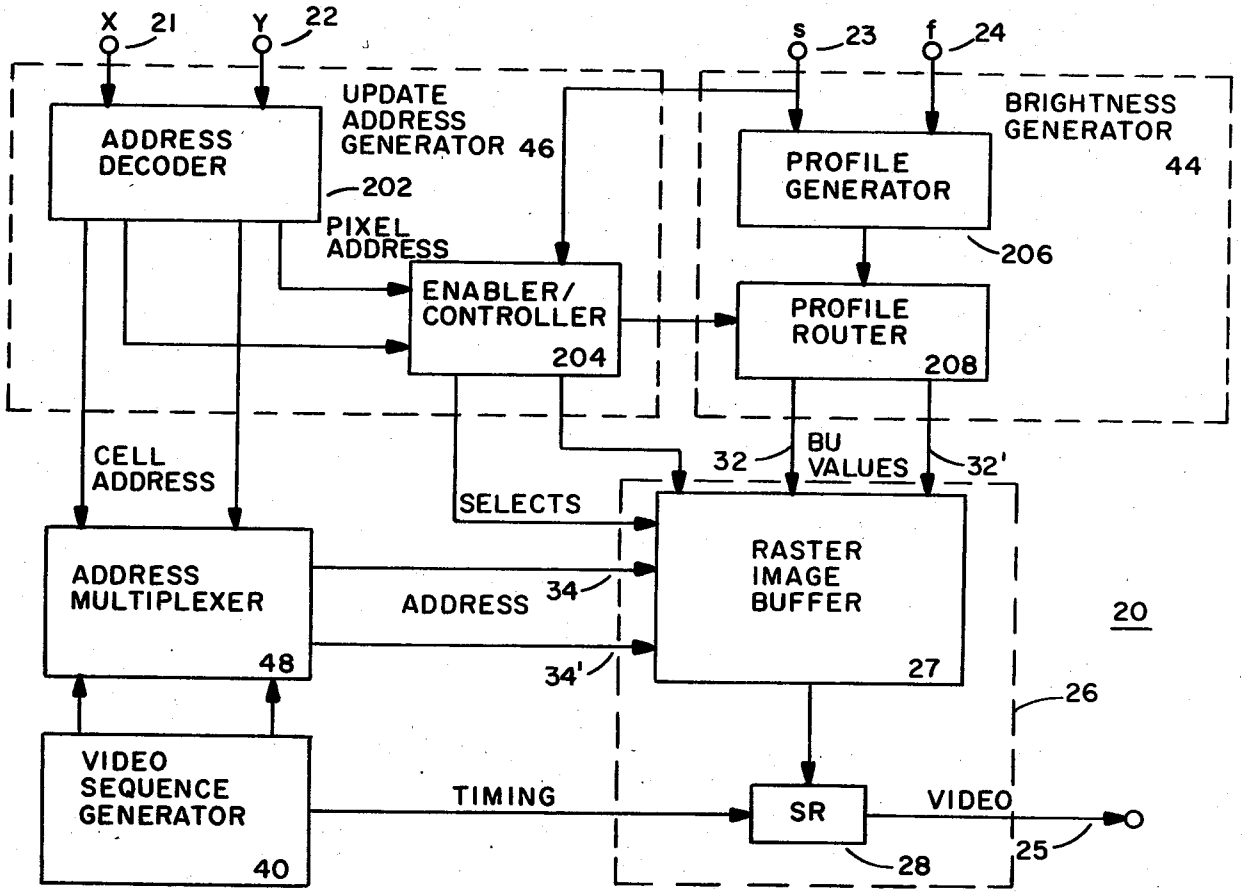
FIG. 2 shows the block diagram of FIG. 1 expanded to show more details of the update address generator and the brightness generator.

Referring now to FIG. 2, there is shown in more detail the display generator 20. Update address generator 46 includes means for converting intra-cell addresses and slope signals into enabling signals and takes the form of an address decoder 202 and an enabler/controller 204.

Brightness generator 44 includes a profile generator 206 receiving slope signals and fractional position signals and producing brightness values for each pixel within a section, and pixel routing means in the form of a profile router 208 for sending pixel brightness values to the appropriate memory element in the storing means 26.

The apparatus of FIGS. 1 and 2 shows in detail the arrangement for smoothing out the stair-step effects inherent in the raster display of line segments: line smoothing. The inputs to the display system, 21 and 22, are in the form of pixel position (X and Y), the amount of slope "s" of the line segment, at 23, and the fractional position "f" of the center of brightness within the pixel, along the axis at the center of the section, parallel to the section, at 24.

Raster image buffer 27 can be considered to consist of read/write memory elements arranged as an m by n matrix. Each address of this image buffer 27 constitutes an area by m by n pixels on the display 10, this area known as a cell. The number of cells constituting a display area is therefore limited by the number of possible addresses obtainable in the raster image buffer 27. The X and Y inputs refer to pixel positions, and these are converted to cell address and pixel (or memory element) address within the cell by the update address generator 46.

The brightness values for all pixels in the section of line segment being considered is generated in the brightness generator 44 from the inputs of slope "s" of the line segment and the fractional part of the position "f" of the center of brightness along the center axis parallel to the section. The brightness values derived are then stored in the memory elements appropriate for those pixels at the required address as generated by the update address generator 46.

The video sequence generator 40 reads data out of the raster image buffer 27 for display purposes. It generates the addresses required for output in the correct sequence and generates the timing required to present video to the display surface. The address multiplexer 48 serves to allow the address to the raster image buffer 27 to come from the two sources described above, to allow the raster image buffer to be updated via the inputs to the system (X, Y, f and s), or the raster image buffer to be read from, to allow display refresh. Shift register 28 serves to read out video data from the raster image buffer 27 in parallel and serially shifted out at video rate. Parallel data from the raster image buffer allows the operational speed of the raster image buffer to be greatly reduced from that of the video rate.

Referring again to FIG. 2, update address generator 46 includes an address decoder 202 and an enabler/controller 204. Address decoder 202 serves to convert the pixel position (X and Y) into a cell address and an intra-cell address. Enabler/Controller 204 serves to generate all of the pixel (or intra-cell) addresses of the raster image buffer 27 that are updated for any section of the line segment. The pixels affected, and thus enabled within the cell via the enabler/controller 204, via the selects, by any section of line segment is dependent upon the pixel position of center of brightness and the slope of the line (in particular, whether the line segment slope is greater or less than unity).

Brightness generator 44 includes a profile generator 206 along with a profile router 208. Profile generator 206 produces the brightness value of each pixel within a section of line segment. These brightness values are dependent upon the slope of the line segment and the fractional position of the center of brightness along the axis at the center of and parallel to the section. The brightness values of the pixels within a section (produced by the profile generator 206) then must be placed at the input of the appropriate memory elements of the raster image buffer. This is accomplished by the profile router 208. Routing to the appropriate memory elements is dependent upon the position of center of brightness within the raster image buffer and the slope of the line segment (greater or less than unity) and is therefore controlled by the enabler/controller 204 which has the required inputs.

In order to understand better the operation of the display system of the present invention, it would appear to be useful to review the construction of a line segment in a raster scanned format. Consider a segment of a line to be displayed in raster form, such is shown at b in FIG. 3 (a is an ideal line). If the line segment is at any angle other than zero, it will appear as a series of stair-steps as shown at c in FIG. 3, due to the quantization effects of the raster lines and pixels. If the line segment is one pixel or less in width, and of zero slope, than it will be displayed only in one field of an interlaced raster format. This would cause an undesirable blinking in typical 30/60 television raster systems. If the line segment is rotatable, the stair-step will appear to move, and if the line segment is not programmed to an integer value of raster lines and pixels, it will change length, crawl, as it is translated across the display. Line smoothing can reduce these visible and undesirable effects.

In considering smoothing of line segments only, and not surface edges, it becomes apparent that line segments widths become a visible parameter, i.e., how wide does a line segment appear to the viewer? The line smoothing capability can be specified and hardware/-software implemented in terms of line segment widths. Further, the implementation of the line smoothing function into hardware can be simplified by taking into account the slope of the line. The center of any line to be drawn can be considered as a series of points, where the distance between adjacent points can be considered as delta X(ΔX) and delta Y(ΔY). If the slope is less than or equal to unity, the delta X function can be set to unity and delta Y will always be less than or equal to unity. If the slope is greater than or equal to unity, the delta Y function can be set to unity, and delta X will always be less than or equal to unity. The case of slopes less than unity will be considered first.

Figure 3:
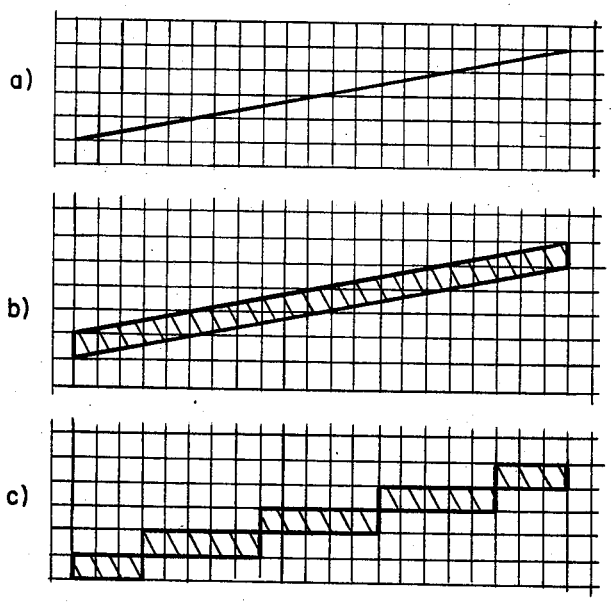
FIG. 3 shows a programmed line, its desired appearance, and its true appearance without line smoothing.

Referring to FIG. 3, the line a has a slope of 0.2. If it has a width of one pixel, the desired appearance would be as shown at b. However, raster quantization effects reproduce it as shown at c.

Figure 4:
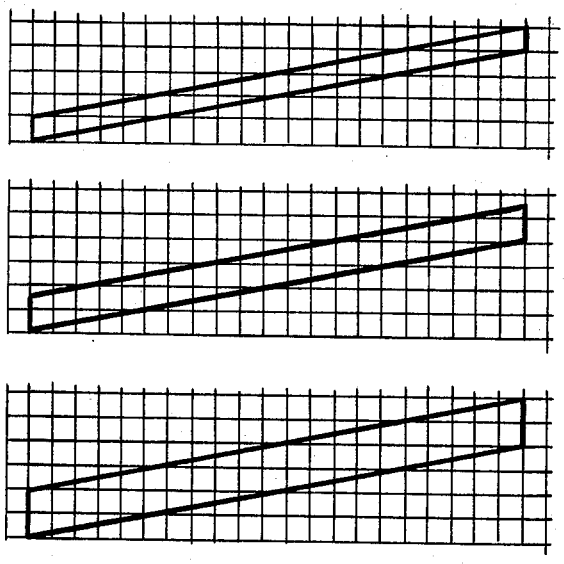
FIG. 4 shows the line of FIG. 3 with the desired appearance for line widths of 1, 1.5, and 2.0 pixels.

FIG. 4 shows the same line as in FIG. 3 with the desired appearance for widths of 1, 1.5, and 2.0 pixels. Line smoothing can approximate this desired appearance by shading the pixels adjacent to the desired line according to the area the line occupies within each pixel. This effect is realized from that of a conventional television camera.

When the beam within a television camera sweeps across an image containing a line segment of high contrast (FIG. 5), it does not generate a stair-step effect. This is due partly to the limited bandwidth of the television system, but even more so to the fact that the camera's video output is proportional to the area of line segment covered by the spot diameter of the beam as it sweeps across the line segment. Thus, at any moment the shade of a raster line, when shown in a raster display, is proportional to the area of the line segment covered by the beam's spot diameter. This same analog effect can be approximated by shading raster pixels in proportional to the area the line segment occupies within the pixels.

Figure 5:
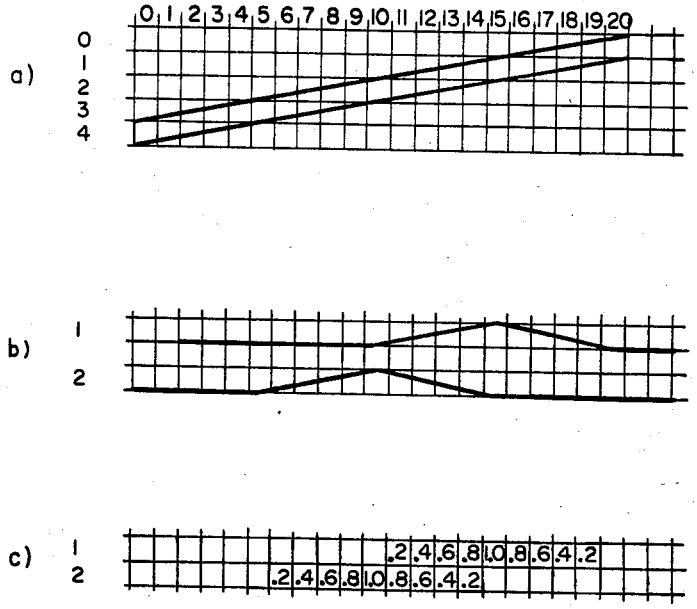
FIG. 5 shows a line segment as it is scanned by a television camera and the relative video level output from the camera for the raster lines that sweep across the line segment.

Referring now to FIG. 5, there is shown a portion of a line segment as it is scanned by a television camera. At b there is shown the relative video level output from the camera for the raster lines that sweep across the line segment of a. At c there is shown the illumination of the raster lines when they are displayed upon a CRT display. The shade of the raster line will vary according to the video level. The point marked 1.0 on raster line 2 in c reflects the highest intensity of the raster line as it totally encompasses the line segment shown in a. The lesser or smaller numbers reflect the intensities according to line segments areas encompassed by the scanning spot of the camera. The net effect of all this accumulates in the observer's eye, which will integrate these varying shades, if the pixel size is small relative to the viewing angle, into the original line scanned by the camera.

Figure 6:
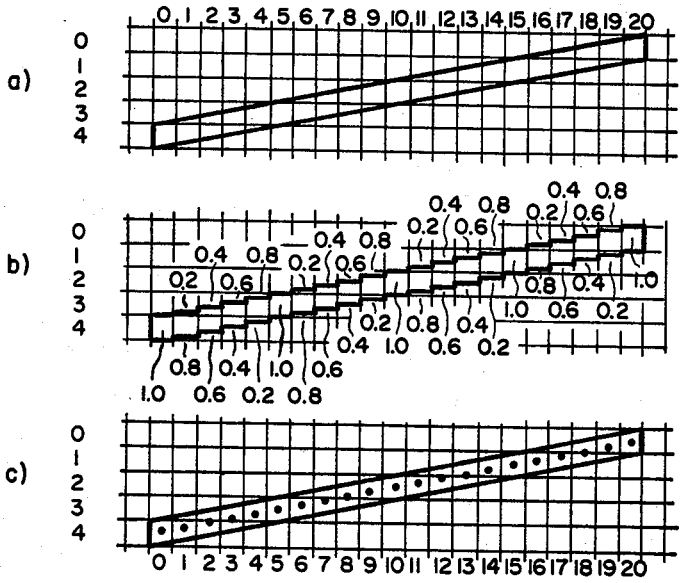
FIG. 6 shows the required shading of each pixel on each raster line to obtain a smooth appearance of the line segment shown in the top of the figure and the positions of the center of brightness at the center of each pixel in the X axis.

This same effect is achievable in a digitally generated display by shading each pixel according to the area that the line segment of a given width overlays that particular pixel. Referring to FIG. 6, b shows the required shading of each pixel on each raster line to obtain a smooth appearance of the line as shown at a. At c is shown the positions of the center of brightness at the center of each pixel on the X axis. Pixel 5 in line 3 and pixel 10 in line 2 must be at full brightness as the center of brightness is at the center of the pixel. For each pixel to the right, the center of brightness moves up by 20% of a pixel, and the desired shading for each pixel thus follows the pattern as shown at b.

Such a line smoothing scheme essentially improves the resolution that is limited by the raster line/pixel quantization by modulating the brightness and utilizing the integrating effects of the eye.

For any given line slope less than unity, the line smoothing scheme presented herein modulates the shades of pixels according to the line's width and the fractional part of the Y axis position of center of brightness at the center of each pixel in the X axis. For a slope greater than unity, all adjacent horizontal pixels requiring shading are similarly modulated according to this scheme.

Figure 7:
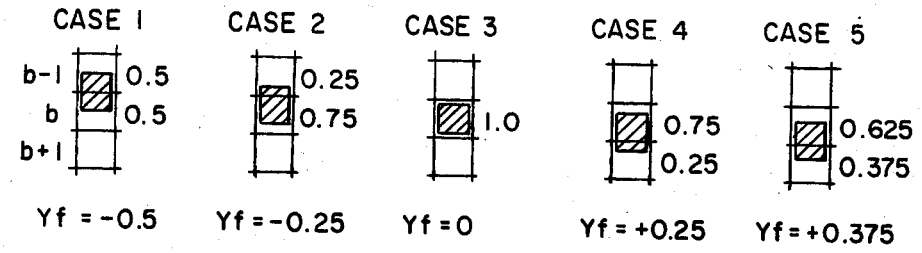
FIG. 7 shows five cases of a line segment overlaying pixels with a vertical width of one pixel.

Referring to FIG. 7, there are shown five cases of a line segment overlaying pixels. The origin point of each pixel is at center. In all cases, the line segment's center point is considered to be on raster line b. In case 1, the Y position of the line segment is minus 0.5. This addresses a point on the edge of a pixel (equidistant from two pixel centers) and the line segment therefore covers both lines b-1 and b equally. In case 2, the position address has a fractional part of $\frac{1}{4}$ of the raster line. The line segment would (if the additional resolution were available, and it is not) occupy $\frac{1}{4}$ of the pixel on raster line b-1 and $\frac{3}{4}$ of the pixel on raster line b. As the line segment's position moves downward within the pixel, it would address the raster line as shown in the remaining cases. Note that its width carries it over three different raster lines (b-1, b, and b+1) as its position moves over one raster line b.

As mentioned before, each pixel is shaded in proportion to the pixel area that the line segment overlays. For lines with slopes less than unity, this is easily implemented in hardware/software by shading adjacent vertical pixels according to the fractional value of the input Y value. Note that the shade of the b line pixel smoothly increases until the center of brightness is in the center of the pixel and then begins decreasing. At this same point, the b-1 pixel's shade has gone to zero and the b+1 pixel will start to increase in shading. Equations for the shading of these pixels are given in Table 1.

TABLE 1

| Shading Equations, Vertical Width = 1.0 | | | |
|---|---|---|---|
| Yf | SH(b − 1) | SH(b) | SH(b + 1) |
| +0.5 > YF ≧ 0 | 0 | 1.0 − Yf | Yf |
| 0 ≧ YF ≧ −0.5 | −Yf | 1.0 + YF | 0 |

Note that at this discontinuity (Yf=0), the line segment lies only on line b. In a 30/60 raster system, this line segment will lie only in one raster field and will therefore flicker at the field rate. To avoid this, a non-interlaced raster system must be used or the width of the line segment increased to prevent this situation. Actually, there are other reasons for increasing line segment width, one of which is to generate symbology with a sufficient line width to symbol height ratio for easy recognition.

Figure 8:
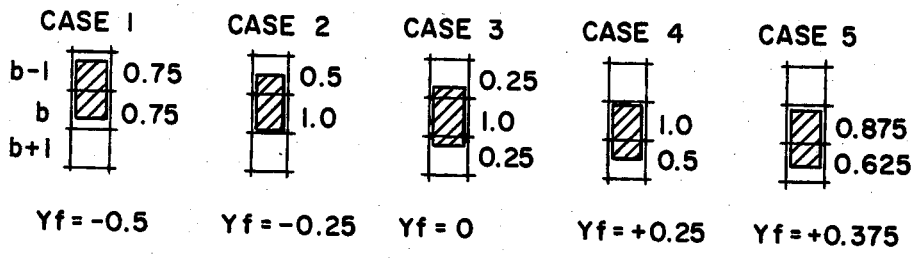
FIG. 8 shows five cases of a line segment of width 1.5 pixels.
Figure 9:
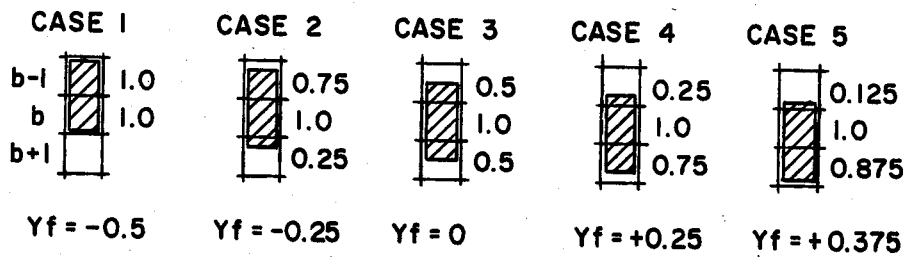
FIG. 9 shows five cases of a vertical line segment having a width of 2.0 pixels.

FIGS. 8 and 9 describe line segments of widths 1.5 and 2.0 pixels, respectively. Tables 2 and 3 respectively give the shading equations.

TABLE 2

| Shading Equations, Vertical Width = 1.5 | | | |
|---|---|---|---|
| Yf | SH(b − 1) | SH(b) | SH(b + 1) |
| +0.5 > YF ≧ +0.25 | 0 | 1.25 − Yf | 0.25 + Yf |
| +0.25 ≧ YF ≧ −0.25 | 0.25 − Yf | 1.0 | 0.25 + Yf |

TABLE 2-continued

| Shading Equations, Vertical Width = 1.5 | | | |
|---|---|---|---|
| Yf | SH(b − 1) | SH(b) | SH(b + 1) |
| −0.25 ≧ YF ≧ −0.5 | 0.25 − Yf | 1.25 + Yf | 0 |

TABLE 3

| Shading Equations, Vertical Width = 2.0 | | | |
|---|---|---|---|
| Yf | SH(b − 1) | SH(b) | SH(b + 1) |
| +0.5 > YF ≧ −0.5 | 0.5 − Yf | 1.0 | 0.5 + Yf |

Figure 10:
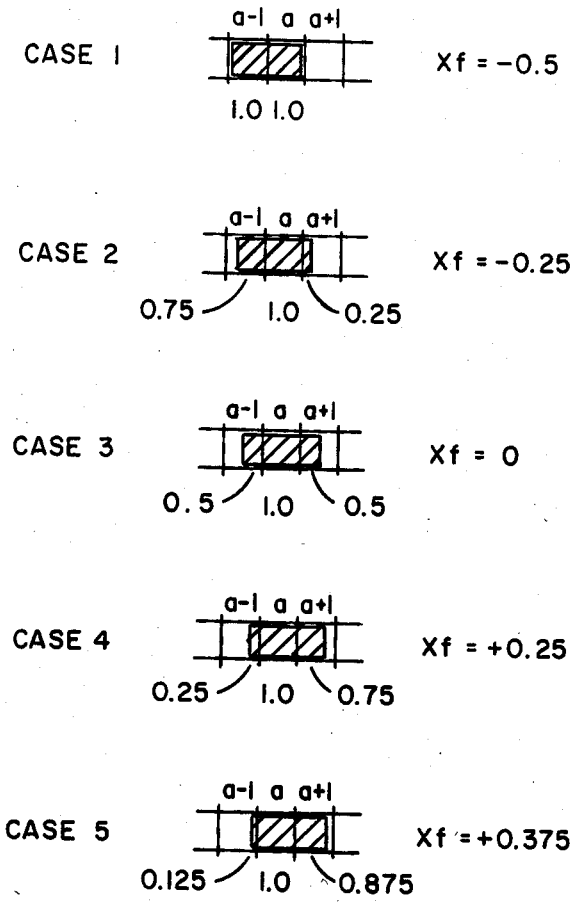
FIG. 10 shows five cases of a horizontal line segment of 2.0 pixel width.

For line segment slopes greater than unity, adjacent horizontal pixels are shaded similarly to those explained for lesser slopes. FIG. 10 shows shading for line segments of two pixel widths for lines slopes greater than unity. Table 4 provides the shading equations.

TABLE 4

| Shading Equations, Horizontal Width = 2.0 | | | |
|---|---|---|---|
| Xf | SH(a − 1) | SH(a) | SH(a + 1) |
| +0.5 > YF ≧ −0.5 | 0.5 − Xf | 1.0 | 0.5 + Xf |

Figure 11:
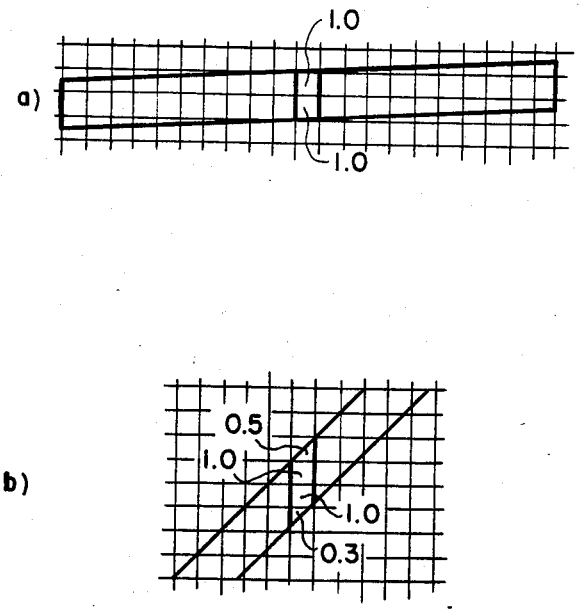
FIG. 11 shows two examples of a line of mean width of 2.0 pixels, one being near horizontal and one being near 45 degrees.

Up to this point, the width of the line has been considered as 1.0, 1.5, or 2.0 pixels in the vertical direction for FIGS. 7 to 9 (and 2.0 pixels in the horizontal direction for FIG. 10). In reality, for a line to have constant width, e.g., when rotating, it is the mean width that should be constant, and the pixel shading should be outputted to provide this effect. FIG. 11 shows two examples of a line of mean width of 2.0 pixels. For the line shown at a in FIG. 11, vertical width=2.0/(cos [arc tan][1/20]])=2.0025. For the line segment shown at b in FIG. 11, vertical width=2.0/(cos [arc tan]19/20]])=2.7586.

Figure 12:
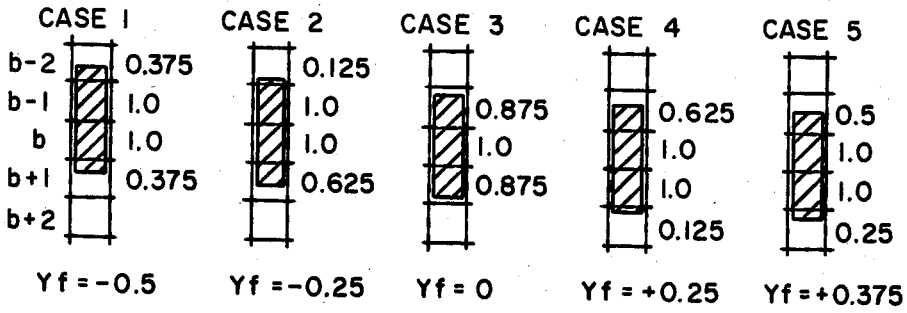
FIG. 12 shows five cases of a vertical line segment of 2.75 pixels representing a line segment of mean width of 2.0 pixels at or near 45 degrees.

For line a in FIG. 11, the pixel shading shown in FIG. 9 and corresponding equations of Table 3 are adequate (where vertical width is assumed as 2.0 pixels). For the line shown at b in FIG. 11, the vertical width is 2.75 pixels and the pixel shading shown in FIG. 12 and corresponding equations at Table 5 must be used. It should be noted that the vertical width of 2.75 (derived from a mean width of 2.0) carries it over five pixels (b-2, b-1, b, b+1, and b+2) as its position moves over one raster line.

TABLE 5

| Shading Equations, Vertical Width = 2.75 | | | | | |
|---|---|---|---|---|---|
| Yf | SH (b − 2) | SH(b − 1) | SH (b) | (b + 1) | SH (b + 2) |
| +0.5 > YF ≧ +0.125 | 0 | 0.875 − Yf | 1.0 | 1.0 | Yf − 0.125 |
| +0.125 ≧ YF ≧ −0.125 | 0 | 0.875 − Yf | 1.0 | 0.875 + Yf | 0 |
| −0.125 ≧ YF ≧ −0.5 | −Yf − 0.125 | 1.0 | 1.0 | 0.875 + Yf | 0 |

In FIG. 11 there are shown only two extreme examples: near horizontal and near 45 degrees. Obviously, for slopes between these values, other vertical widths must be used for constant mean width. It therefore becomes obvious that the shading used for each pixel is dependent upon the fractional position of the center of brightness and the line's slope.

For line slopes greater than unity, adjacent horizontal pixels are shaded similarly to those adjacent vertical pixels when line slopes are less than unity.

To construct a table of shading equations for line segments with slopes less than unity, and with a constant mean width, the following steps should be carried out:

1. Deterine minimum and maximum vertical width:
   Minimum vertical width (v)=m (for horizontal lines)
   Maximum vertical width (v)=m/cos 45
2. For movement of center of brightness over one pixel determine extreme values for both edges.
3. Determine discontinuities (i.e. which pixel boundaries are crossed between the extreme values found in step 2).
4. Find all ranges of center of brightness for movement over one pixel, where each range is defined by a line segment edge at a pixel boundary.
5. Derive shading equations for each pixel for each range.

As an example consider a mean width of 2.0:

| | |
|---|---|
| 1. Minimum vertical width = | 2.0 |
| Maximum vertical width = | 2.0/ cos 45 |
| = | 2.83 |

Figure 13:
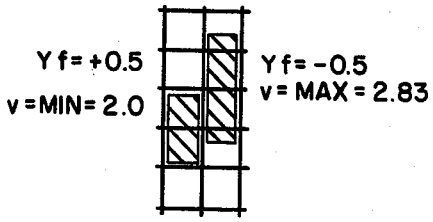
FIG. 13 shows two cases to be considered for the extreme values of top edge.
Figure 14:
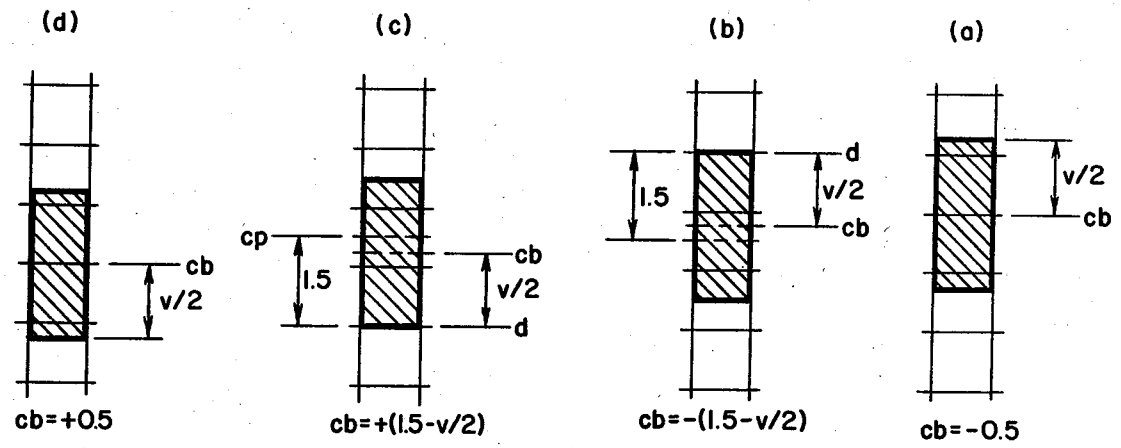
FIG. 14 shows the position of a vertical section in the four cases that determine limits of the ranges.

2. FIG. 13 shows the two cases to be considered for the extreme values of the top edge, where the right section represents the maximum width (2.83) at the top most position of the center of brightness within the pixel (−0.5) giving the top limit of the top edge of the line, and the left section of FIG. 13 represents the minimum width (2.00) at the bottom most position of the center of brightness within the same pixel (+0.5) giving the bottom limit of the top edge of the line.
   Top limit of top edge=−0.5−2.83/2=−1.915
   Bottom limit of top edge=+0.5−1.0=−0.5
   Similarly, extreme values of bottom edge=+0.5 and +1.915.
3. The pixel boundaries occur at ±/−0.5, +/−1.5, +/−2.5 etc. Therefore discontinuities occur at + and −1.5 (between ±0.5 and ±1.915).
4. FIG. 14 shows the section with the center of brightness at the four positions of interest, giving the limits of the ranges:
   (a) the extreme top position of the center of brightness within the pixel (cb=−0.5)
   (b) with top edge of section at a discontinuity (cb=−(1.5−v/2))
   (c) with bottom edge of section at a discontinuity (cb=+1.5−v/2)
   (d) the extreme bottom position of the center of brightness within the pixel (cb=+0.5)
   Ranges are therefore as follows:
   $-0.5 \leqq y_f \leqq -(1.5-h/2)$
   $-(1.5-h/2) \leqq Y_f \leqq +1.5-h/2$
   $+1.5-h/2 \leqq Y_f \leqq +0.5$
5. Construct table 6

TABLE 6

| Yf | Shading Equation: Mean Width = 2.0 and Line Slope < unity | | | | |
|---|---|---|---|---|---|
| | SH(b − 2) | SH(b − 1) | SH(b) | SH(b + 1) | SH(b + 2) |
| $+0.5 > Yf \geqq +r$ | 0 | $1 - r - Yf$ | 1.0 | 1.0 | $Yf - r$ |
| $+r \geqq Yf \geqq -r$ | 0 | $1 - r - Yf$ | 1.0 | $1 - r + Yf$ | 0 |
| $-r \geqq Yf \geqq -0.5$ | $-Yf - r$ | 1.0 | 1.0 | $1 - r - Yf$ | 0 |

Where $r = 1.5 - v/2$
$v = m/\cos[\arctan(\Delta Y/\Delta X)]$
and m = mean width of line to be drawn = 2.0

Figure 15:
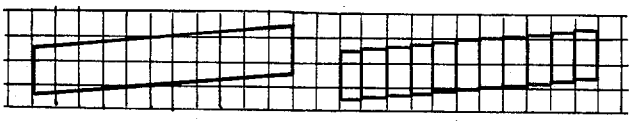
FIG. 15 shows two examples of how lines can be generated including the situation where the slope of the line is less than unity and the situation where the slope is greater than unity.
Figure 15:
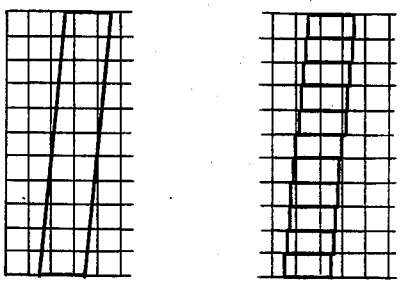

Up to this point, pixel shading has only been considered for individual points. To draw lines on a raster display, a series of points has to be considered, where each point contributes to a section of the line. In FIG. 15 there are shown two examples of how lines can be generated: at a where the slope is less than unity (a near horizontal line) and at b where the slope is greater than unity (a near vertical). As seen at a in FIG. 15, the line is constructed of vertical sections, each with a horizontal width of one pixel, and the center of brightness of each point is at the mid-point in the horizontal axis; i.e., fractional part of the X position equals zero. It is thus the fractional part of the Y position of each point and the slope of the line that determines the shading value of each pixel for each section. As seen at b in FIG. 15, there appears a near vertical line constructed of horizontal sections. The same principles applies as for the near horizontal lines but with the X and Y axes swapped.

Figure 16:
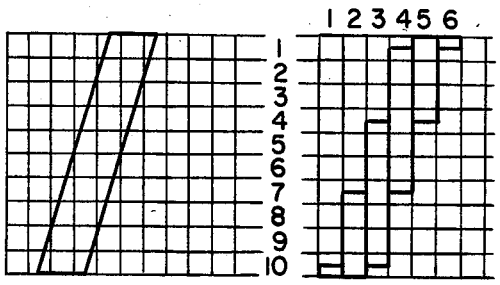
FIG. 16 shows the construction of a near vertical line from vertical sections.

By considering a crossover point at 45 degrees for horizontal or vertical line sections, the number of pixels covered by each section is minimized. As an example, refer to FIG. 16 where a near vertical line is attempted to be constructed from vertical sections. Here each section is larger, and not every outer pixel is capable of being given a fractional (shaded) value; e.g., line 6 pixel 3, line 5 pixel 4, etc.

While the invention has been described in terms of a selected preferred embodiment, it should not be deemed limited thereto, since other embodiments and modifications will readily occur to those skilled in the art. It is therefore to be understood that the appended claims are intended to cover all such modifications which fall within the true spirit and scope of the invention.

We claim:

1. A display system for smoothing out stair-step effects in the raster display of information having line segments, said display system comprising:

a raster scanned display including a surface having a plurality of pixels for displaying information to a viewer; and a display generator for generating video signals to control said display in displaying line segments, said display generator including:

(a) a brightness generator responsive to input signals for dividing each line segment to be displayed into a plurality of sections each made up of one or more pixels and for determining individual brightness values of said pixels in proportion to the amount of surface area of those of said pixels in each section overlaid by said line segment to be displayed, (b) a memory, (c) means responsive to pixel address signals for addressing said memory to store said pixel brightness values in memory locations associated with each said pixel of each section, and (d) a video sequence generator for addressing said memory in a predetermined sequence to retrieve said pixel brightness values pursuant to the generation of said video signals to said raster display.

2. The invention of claim 1 wherein said input signals to said brightness generator include first signals representative of the slope of each line segment and second signals representative of the fractional position of a center of brightness for each section of each line segment along the axis at the center of and parallel to each section, and wherein said brightness generator further includes:

means responsive to said first and second signals for generating said pixel brightness values from the slope of each line segment and the fractional position of said center of brightness for each section of each line segment, and said display generator further including an update address generator for addressing said memory in a sequence determined by said input signals and pixel address signals.

3. The invention of claim 2 wherein said display generator further includes means for routing the outputs of said video sequence generator and said update address generator to said memory.

4. The invention of claim 1 wherein said display generator further comprises a shift register receiving timing information from said video sequence generator and converting information received from said memory into said video signals.

5. The invention of claim 2 wherein said display surface is divided into a predetermined number of cells, each cell including a second predetermined number of said pixels, and wherein said pixel address signals include X and Y addresses for each said pixel, and wherein said update address generator includes an address decoder for converting the X and Y addresses for each said pixel into a cell address and into an intra-cell address for accessing said memory.

6. The invention of claim 5 wherein said update address generator further includes means for converting said intra-cell addresses and slope signals into enabling signals.

7. The invention of claim 6 wherein said memory includes a plurality of memory elements, corresponding on a one to one basis to said pixels within each said cell.

8. The invention of claim 7 wherein said enabling signals enable the appropriate memory elements to be loaded with said brightness values.

9. The invention of claim 8 wherein said means for generating said pixel brightness values includes:

a profile generator receiving said first and second signals and producing said brightness values for each said pixel within each section; and pixel routing means for sending said pixel brightness values to the appropriate one of said memory elements in said memory.

10. A method for overcoming stair-step effects inherent in displaying a line segment on a raster display having a matrix array of pixels, including the steps of:

constructing a line segment of finite width;

dividing said line segment into equal parallelogram-shaped line sections each having a short dimension one pixel in width and a long dimension orthogonal thereto;

dividing the long dimension of each of said line sections into a proportionate number of one or more pixels;

determining the percentage of the area of each pixel of each said section common to said line segment as would be displayed on the display;

determining a brightness value for each pixel of each said section in proportion to its respective percentage of area common to said line segment; and activating said pixels in accordance with the above-determined brightness values to display said line segment on the raster display.

11. The method of claim 10 where said raster display has a width x and a height y, wherein said line segment is divided into said sections, orthogonal to the longer of the x and y components of said line segment.

12. The method of claim 11 further including converting said parallelogram-shaped sections into rectangles of equal area to the parallelograms by constructing the lesser sides of the rectangle to pass through the mid-points of the sides of the parallelogram coinciding with the sides of said line segment.

* * * * *